US005706879A

United States Patent [19]

Renner et al.

[11] Patent Number: 5,706,879

[45] Date of Patent: Jan. 13, 1998

[54] PROCESS FOR THE RECLAMATION OF USED FOUNDRY SAND

[75] Inventors: Christian Renner, Beringen; Xaver Naf, Winterthur; Jovo Laskovic, Schaffhausen, all of Switzerland

[73] Assignee: Georg Fischer Giessereianlagen AG, Schaffhausen, Switzerland

[21] Appl. No.: 431,120

[22] Filed: Apr. 28, 1995

[30] Foreign Application Priority Data

Jun. 15, 1994 [CH] Switzerland ..... 01 885/94

[51] Int. Cl.[6] ..... B22C 5/00; B02C 19/12

[52] U.S. Cl. ..... 164/5; 241/19; 241/275; 241/DIG. 10

[58] Field of Search ..... 164/5; 241/DIG. 10, 241/26, 19, 275

[56] References Cited

U.S. PATENT DOCUMENTS

| | | | |
|---|---|---|---|
| 315,143 | 4/1885 | Hudson et al. | 241/275 |
| 1,393,092 | 10/1921 | Davis | 241/DIG. 10 X |
| 2,580,579 | 1/1952 | Neenan | 241/275 X |
| 3,312,403 | 4/1967 | Zifferer | 241/DIG. 10 X |
| 3,982,702 | 9/1976 | Barnhart et al. | 241/DIG. 10 X |
| 4,436,138 | 3/1984 | Kondo | 164/5 |

FOREIGN PATENT DOCUMENTS

| | | | |
|---|---|---|---|
| 2408981 | 9/1975 | Germany | 164/5 |
| 56-19947 | 2/1981 | Japan | 164/5 |
| 784971 | 12/1980 | U.S.S.R. | 164/5 |
| 1379069 | 3/1988 | U.S.S.R. | 164/5 |
| 1611546 | 12/1990 | U.S.S.R. | 164/5 |
| WO94/07627 | 4/1994 | WIPO | 164/5 |

*Primary Examiner*—J. Reed Batten, Jr.
*Attorney, Agent, or Firm*—Bachman & LaPointe, P.C.

[57] ABSTRACT

An apparatus for reclaiming used foundry and molding sand comprises a container having a cylinder sidewall and at least one bottom wall or tray is arranged on a sand reclamation device for the mechanical cleaning of grains of sand, particularly organically and inorganically bonded molding sands. A central, hollow drive shaft is arranged in the cylinder and is supported for rotation. The bottom walls are firmly attached to the hollow shaft. A slot is formed between the bottom walls and cylinder. By the rotation of the bottom walls a parting plane is formed between the rotating part and the stationary part of the column of sand, in which plane an intensive rubbing of grain against grain takes place. As a result of the cylindrical force, the sand is brought in the direction towards the wall of the cylinder and through the slot, which additionally leads to an intensive rubbing of grain against grain. The powder produced upon the rubbing, primarily binder particles which have been rubbed off, is drawn off continuously through the hollow shaft by means of the suction via openings which are provided in the hollow shaft.

5 Claims, 3 Drawing Sheets

PROCESS FOR THE RECLAMATION OF USED FOUNDRY SAND

BACKGROUND OF THE INVENTION

The present invention relates to a process and apparatus for the reclamation of predominantly resin-bonded used foundry sand, as well as of thermally stressed bentonite-bonded molding sand for the reuse thereof instead of new sand, by the mechanical separation of the sand grain from portions of the binders.

An apparatus is known (Federal Republic of Germany 29 09 408 A1) which has a horizontal, rotating drum and an impact rotor which is arranged within the drum in the region of a descending stream of used sand. In this apparatus, the sand is scrubbed in the manner that it is suddenly accelerated upon impinging on the impact tool and thrown into the sand curtain or sand basin, whereby an intensive rubbing of grain against grain is obtained. This apparatus has the disadvantage that the sand is reclaimed only batchwise.

The object of the present invention is to provide a process and an apparatus in which the grains of sand can be gently cleaned by repeated rubbing and in which continuous reclamation of the sand is possible. The apparatus should be of simple construction in order also to achieve optimal economy.

SUMMARY OF THE INVENTION

The foregoing object is achieved by the present invention wherein an apparatus comprises an apparatus for use in reclaiming used foundry and molding sand by mechanical separation of portions of binder from granular sand base comprising a container having a cylindrical sidewall portion about a cylindrical axis and a bottom wall portion, the bottom wall portion being spaced from the sidewall portion so as to define therebetween a radially extending slot; a hollow shaft disposed about the cylindrical axis, the shaft projecting through a bore in the bottom wall portion along the axis and into the container, the shaft being fixed to the bottom wall; and motor means for rotating the shaft and the bottom wall.

The essential advantage of the invention is that the used sand is reclaimed by gentle rubbing of the grains against each other. No impact or beating action takes place.

By the design of the apparatus, the rubbing of grain against grain can easily be repeated several times by providing several cleaning stages.

Maintenance-free reclamation without problems is obtained in the manner that region of the apparatus which is subject to wear is provided with wear elements.

The drive shaft, which is developed as a hollow shaft, serves at the same time as suction discharge through which the parts of binder which are rubbed off and the powder are continuously drawn off. By different structural developments of the wear elements, the intensity of the cleaning can be varied and the cleaning effect thereby improved.

The layer of binder, which is statically charged by the rubbing of grain against grain, is electrically discharged on guide elements between the reclamation stages. In this way, the sand can be better cleaned.

BRIEF DESCRIPTION OF THE DRAWINGS

The invention will now be explained with reference to an example shown in the drawings.

DETAILED DESCRIPTION

Figure 1:
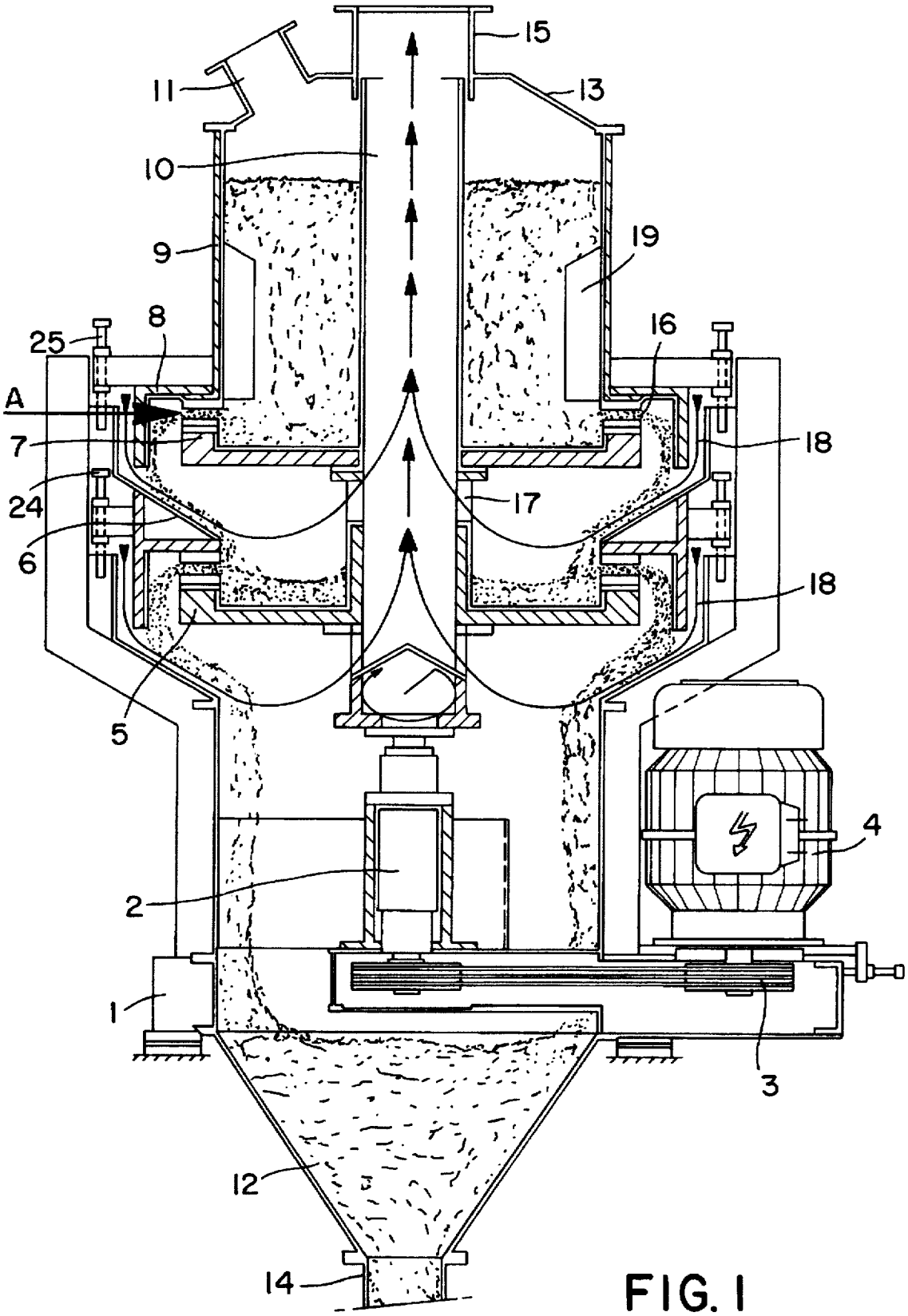
FIG. 1 is a longitudinal section through the sand reclamation device.

FIG. 1 shows a sand reclamation device for the mechanical cleaning of grains of sand, particularly of organically and inorganically bound molding sands. A container comprises a cylindrical sidewall and bottom wall or tray 7 is arranged on a frame 1. The cylinder 9 has a cover 13 on which a sand inlet feed 11 is arranged. Sand restraining elements or baffles 19 which prevent rotation of the column of sand in the cylinder are arranged on the inner wall of the cylinder 9. A deflection element 8 is arranged on the frame 1 in the lower region of the cylinder 9. Below said element 8 there is a funnel-shaped guide element 6. In the lower region of the frame, a sand discharged device 12 in the form of a funnel opens into discharge pipe 14. A central drive shaft 10 is arranged coaxially in the cylinder 9 and terminates in a suction connection 15. The suction connection 15 is developed as a short length of piping with a connecting flange on its end and it serves at the same time as connection for a suction device. A supporting unit 2 is arranged on the lower end of the drive shaft 10, it being driven by a motor 4 via a belt drive 3. The drive shaft 10 is formed as a hollow shaft. The bottom wall or tray 7, acting as collecting container, is firmly attached to the hollow shaft 10. The tray 7 is arranged below the cylinder 9. The tray 7 is spaced at a given distance from the cylinder 9 thus forming a slot 16 between tray 7 and cylinder 9. The width of the slot is continuously adjustable by means of a displacement device 24, 25 for displacing container 9, the displacement being preferably actuated mechanically.

Figure 2:
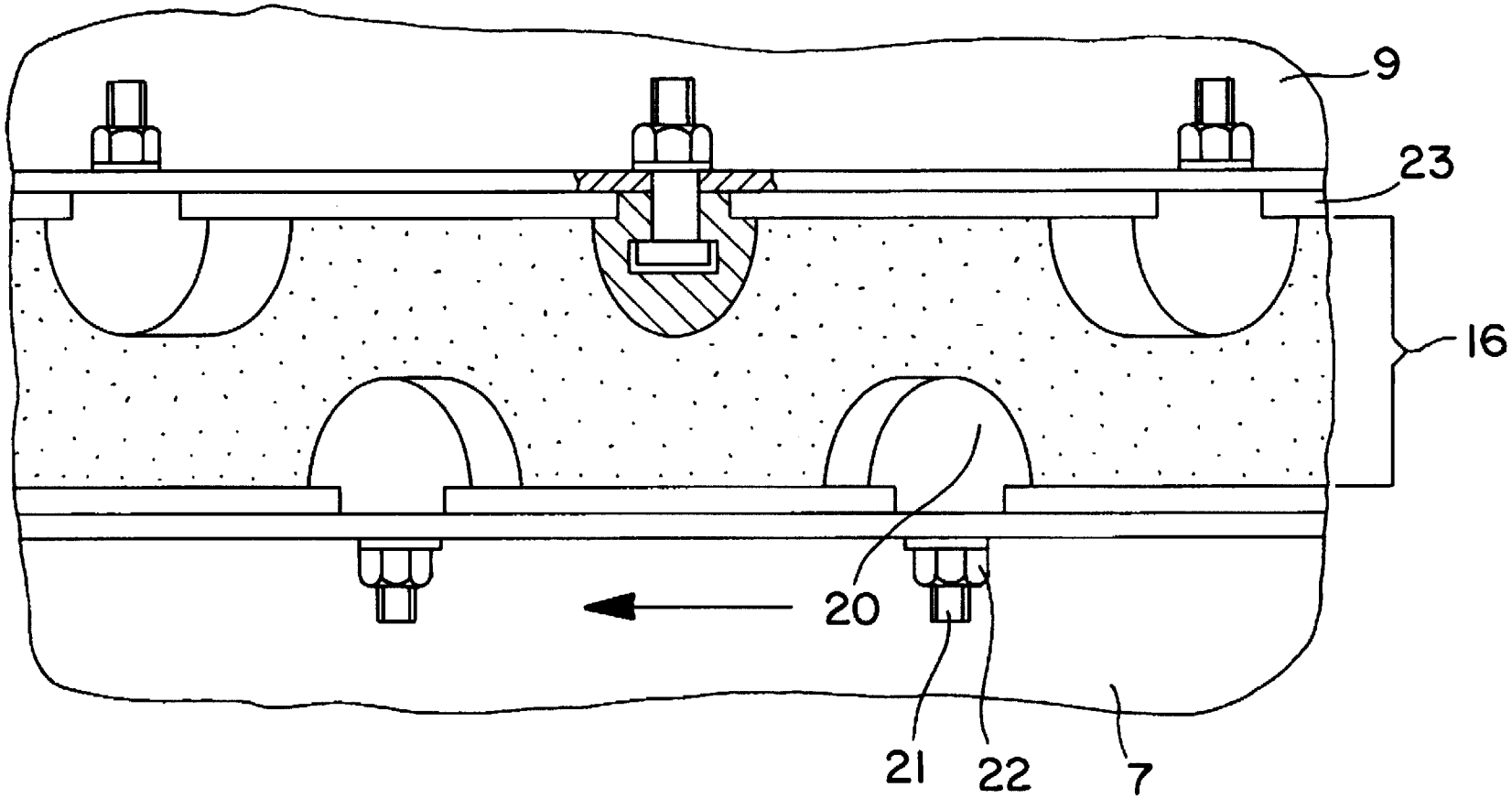
FIG. 2 is a view of the slot seen in the direction A of FIG. 1.

FIG. 2 shows the region of the slot 16 between the tray 7 and the cylinder 9 on a larger scale. Radial rubbing elements 20 are arranged on the facing surfaces of the tray 7 and the cylinder 9. In this embodiment, the rubbing elements 20 have a barrel-shaped cross section. They are replaceably attached to the tray 7 and the cylinder 9, for instance by a threaded piece 21 and a nut 22. Because of the increased danger of wear, the rubbing elements 20 are preferably made of a wear-resistant material such as ceramics, chilled cast iron, carbide metal, metal having a hard facing, etc. By different designs of the rubbing elements 20, the intensity of the rubbing can be changed. Those surfaces which are subject to wear are provided with wear protection 23.

Figure 3:
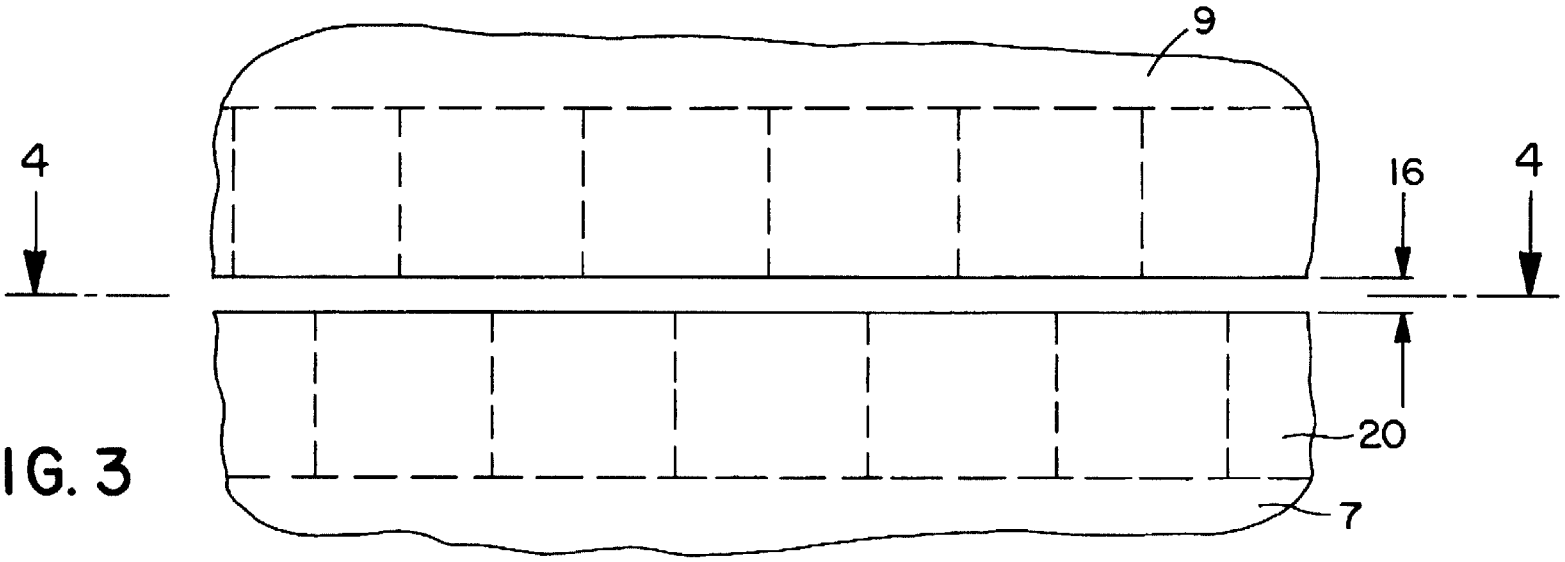
FIG. 3 is a view of the slot seen in the direction A of FIG. 1 with a different embodiment of the slot.
Figure 4:
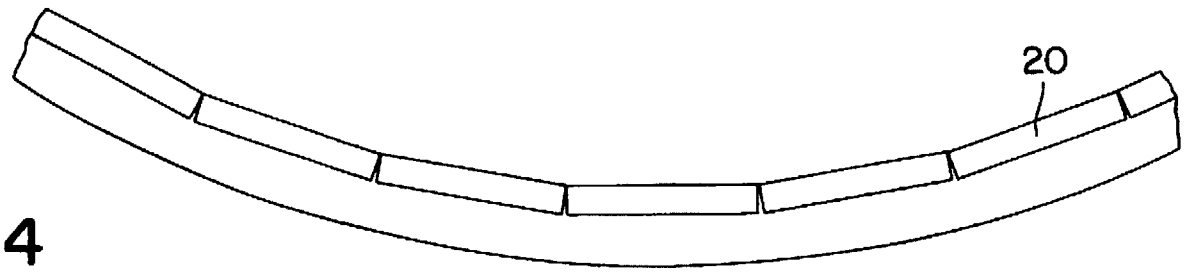
FIG. 4 is a top view of FIG. 3 along the section B—B.

Another variant of the geometry of the slot is shown ins FIGS. 3 and 4. The rubbing elements 20 have a rectangular cross section. They are so arranged that they extend only insignificantly, it at all, into the slot 16.

The sand to be treated is preferably conducted continuously through the sand feed inlet 11 into the cylinder 9, forming in it a stationary column of sand which is torn apart in the region of the slot by the rotation of the tray 7. An intensive rubbing of grain against grain takes place in the parting plane between the stationary column of sand and the rotating portion of sand on the tray 7. The centrifugal force drives the sand in this parting plane in the direction of the slot 16. The sand is forced through the slot 16 in such a manner that, as a result of the geometrical development of the slot 16 and the rotation of the tray 7, a further, more intensive grain-on-grain rubbing takes place. The sand drops out of the slot 16 onto the deflection element 8 and the guide element 6. The guide element 6 is developed as a cathode.

The sand, which has a layer of binder which is statically charged by the rubbing, is electrically discharged upon impingement on the guide element 6. In this way, the sand can be further treated more effectively. The sand which has been treated in this manner falls either into another cleaning stage or into the sand discharge device 12 and is fed again to the sand circuit via the pipe 14. The powder produced by the rubbing of grain against grain and the portions of binder which have been rubbed off are drawn off continuously through the hollow shaft 10 through openings 17 which are arranged in the hollow shaft in the region of the tray 7. The drawing off is effected by a slight vacuum. In the region of the deflection element 8, there are inlet openings 18 through which the feeding of air for the drawing off is possible even during the reclamation process.

With the device described, there is the possibility of providing further reclamation stages in the form of trays 5 on the hollow shaft 10. For each additional tray 5, a slot 16, a deflection element 8, a guide element 6, and openings 17 in the hollow shaft 10 are present. In this way, the result is obtained that, upon each further reclamation stage, the sand is again mechanically cleaned and electrically discharged. The number of reclamation stages may be any desired and can thus be adapted to different requirements of the sand which is to be reclaimed.

The drive of the trays 5 is so designed that the reclamation units can be operated with different, continuously variable speeds of rotation. A speed of rotation of 300–1500 rpm has proven to be particularly favorable.

Batchwise operation is possible with this apparatus. In such case the apparatus is provided with one reclamation stage and the sand is recycled as frequently as desired through the reclamation stage.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

We claim:

1. A process for reclaiming used foundry and molding sand by mechanical separation of portions of binder from granular sand base for reuse as new sand, comprising the steps of:

(a) providing a container having a cylindrical sidewall and a bottom wall spaced from said cylindrical sidewall so as to define therebetween a slot;

(b) providing rubbing elements on at least one of said container sidewall and said bottom wall within said slot;

(c) feeding used sand comprising granular sand base having binder layers into said container so as to form a column of sand in the container;

(d) rotating said bottom wall relative to said cylindrical sidewall so as to (1) rotate a portion of the column of sand against a stationary portion of the column of sand so as to mechanically separate the binder layers as powder from the granular sand base and (2) deflect the rotating sand into said slot for further intensified mechanical separation by said rubbing elements;

(e) feeding the granular sand base and powdered binder layers from said slot onto a guide element for electrically discharging the granular sand base;

(f) suctioning off sand binder layer powder; and (g) recycling said granular sand base for use as foundry and molding sand.

2. A process according to claim 1 including providing a second container for receiving the product of step (e) and repeating steps (d) and (e) in said second container.

3. A process according to claim 1 including continuously reclaiming the used sand.

4. A process according to claim 1 including batchwise reclaiming the used sand.

5. A process according to claim 1 including repeating steps (c), (d) and (e) of claim 1 prior to suctioning and recycling.

* * * * *